US007484471B2

(12) United States Patent
Kalil

(10) Patent No.: US 7,484,471 B2
(45) Date of Patent: Feb. 3, 2009

(54) SKI STORAGE COMPARTMENT FOR A WATERCRAFT

(75) Inventor: Anthony Kalil, Gainesville, FL (US)

(73) Assignee: Bennington Marine LLC, Elkhart, IN (US)

( * ) Notice: Subject to any disclaimer, the term of this patent is extended or adjusted under 35 U.S.C. 154(b) by 22 days.

(21) Appl. No.: 11/195,901

(22) Filed: Aug. 3, 2005

(65) Prior Publication Data

US 2007/0028828 A1 Feb. 8, 2007

(51) Int. Cl.
*B63B 17/00* (2006.01)

(52) U.S. Cl. ..... 114/343

(58) Field of Classification Search ..... 114/343
See application file for complete search history.

(56) References Cited

U.S. PATENT DOCUMENTS 4,827,864 A 5/1989 LaMontagne et al.
4,974,537 A 12/1990 Martin
4,989,535 A * 2/1991 Lacasse et al. ..... 114/343
5,209,177 A 5/1993 Granie et al.
5,522,338 A * 6/1996 Eilert et al. ..... 114/345
5,908,133 A * 6/1999 Luburic et al. ..... 220/572
6,276,290 B1 8/2001 Yamada et al.
6,415,733 B1 7/2002 Hudson et al.
6,553,928 B2 4/2003 Yamada et al.
6,651,573 B2 11/2003 Aselton et al.
6,672,240 B1 1/2004 Aube et al.
2001/0000052 A1 3/2001 Yamada et al.
2003/0183150 A1 * 10/2003 Eck et al. ..... 114/363

* cited by examiner

*Primary Examiner*—Stephen Avila
(74) *Attorney, Agent, or Firm*—Baker & Daniels LLP

(57) ABSTRACT

A ski closet for use on a watercraft having a first portion and a second portion formed in the deck of the watercraft. The ski closet receives and retains water-skis and includes a moveable cover used to conceal the interior portion of the ski closet. When the cover is closed, the cover is arranged flush with the deck of the watercraft. The ski closet further includes a surface configured to retain the water-ski in a set position within the closet. In addition, the closet includes a drain formed in the floor in order allow water that adheres to the surface of the water-ski to drain from the closet.

15 Claims, 5 Drawing Sheets

SKI STORAGE COMPARTMENT FOR A WATERCRAFT

BACKGROUND OF THE INVENTION

1. Field of the Invention

The present invention relates to a ski storage compartment for use in a watercraft. Specifically, the storage compartment is sized and configured to securely store water-skis in a manner allowing the skis to be hidden from view when not in use.

2. Description of Prior Art

Storage compartments for use in watercraft are known in the art. For example, U.S. Pat. No. 5,209,177 discloses a pontoon type boat including a deck and a modified tunnel hull. The tunnel hull includes a storage compartment partially formed in the deck of the craft. The storage compartment has a cover portion capable of being positioned flush with the deck of the boat when closed in order to conceal the interior of the storage compartment. U.S. Pat. No. 5,209,177 also shows a cooler being stored in the storage compartment.

U.S. Pat. No. 6,415,733 discloses a compartment for storing a fishing net in a watercraft. The storage compartment separates the fishing.net from other items stored on the watercraft. The storage compartment includes a hatch with a latch. The hatch conceals the interior of the compartment when closed. The storage compartment also includes a drain allowing water to drain from the storage compartment into the bilge of the craft for cleaning. The storage compartment need not be integrally formed in the deck of the boat. Rather, the patent teaches universal and adjustable mounting brackets that allow the storage compartment to be used in a variety of boat models.

U.S. Pat. No. 6,553,928 discloses a small watercraft, typically referred to as a personal watercraft, including a storage compartment. The storage compartment extends the length of the watercraft. According to the patent, the longitudinal storage compartment may house long articles for storage, such as water-skis or fishing poles. The watercraft includes openings at the stem allowing access to the storage compartment.

U.S. Pat. No. 6,672,240 discloses a deck boat capable of seating multiple passengers while also including ample storage space. For example, the deck boat includes a galley module with a sink mechanism. The galley module includes a storage compartment for housing utensils or other similar items. The deck boat also includes larger storage compartments for housing larger items, such as the motor of the craft. The patent teaches that the motor storage compartment also provides for the storage of water-skis, in addition to the motor.

U.S. patent application Ser. No. 10/209,658 discloses a watercraft including front and rear passenger areas connected by a central passageway. The watercraft further includes a rear bench seat in the rear passenger area. The bench seat extends across the width of the watercraft. In addition, the cushions on the rear bench seat are moveable in order to allow access to a rear storage compartment located under the rear bench seat. The patent explains that the rear storage compartment includes an open area with sufficient size to receive and store water-skis, wakeboards or similar equipment.

SUMMARY OF THE INVENTION

It is an object of the present invention to provide a closet in a watercraft configured to securely store water-skis therein. It is a further object of the present invention to include a mechanism to conceal water-skis when the skis are stored within the closet. In addition, it is an object of the present invention to provide a mechanism to allow water adhering to the surface of a used water-skis placed within the closet to exit the closet.

These and other objects of the invention are achieved by providing a closet for use in watercraft comprising a first storage compartment having a first depth and a second storage compartment having a second depth differing from the first depth. An opening inter-connects the first compartment to the second compartment. In addition, the closet includes a drain in either of the storage compartments thereby allowing water to exit the compartment.

In an embodiment of the present invention, the drain is located within the first compartment. In addition, the closet may also include a second drain located within the second compartment. The drains may be located within the floor of each respective compartment.

In an embodiment of an invention, at least one of the storage compartments may include a plurality of channels formed in the floor thereof. The channels may be located at the intersection between the floor and the walls of the compartment. In an embodiment of an invention, the floor of the compartment slopes toward the drain, and the channels are connected to the drain.

An embodiment of the invention includes a raised portion configured to engage the tip of a water-ski. The raised portion may be positioned at a height intermediate the depth of the first compartment and the depth of the second compartment. In addition, the raised portion may have an arcuate profile to ensure the water-ski does not travel in an undesirable manner within the closet. In an embodiment of the present invention, the raised portion may also include at least one channel allowing water located in a recessed area to flow from the recessed area into the drain and exit the closet.

In an embodiment of the present invention, the closet includes a cover configured to be moveable between an open position and a closed position. In the open position, the cover allows access to the compartments, and in the closed position, the cover does not allow access to the compartments. In addition, the cover may be comprised of two parts allowing the cover to independently cover the first storage compartment or second storage compartment. In an embodiment of the present invention, a plurality of hinges connects the cover to the deck of the watercraft, thereby allowing the cover to rotate between the open and closed positions. Moreover, the deck of the watercraft may also include a recessed area allowing the cover to be flush with the remainder of the deck when the cover is moved into the closed position.

Further scope of the applicability of the present invention will become apparent from the detailed description contained herein. However, it should be understood that the detailed description and specific example, while indicating one embodiment of the invention, are given by way of illustration only, since various changes and modifications within the spirit and scope of the invention will become apparent to those skilled in the art, from this detailed description.

BRIEF DESCRIPTION OF THE DRAWINGS

These and other features of the invention will become more apparent and the present invention will be better understood upon consideration of the following description and the accompanying drawings wherein.

DETAILED DESCRIPTION OF THE EMBODIMENTS OF THE INVENTION

The embodiment of the invention described herein is not intended to be exhaustive, nor to limit the invention to the precise forms disclosed. Instead, the embodiment selected for description has been chosen to enable one skilled in the art to practice the invention, and the claims following this description defines the invention.

Figure 1:
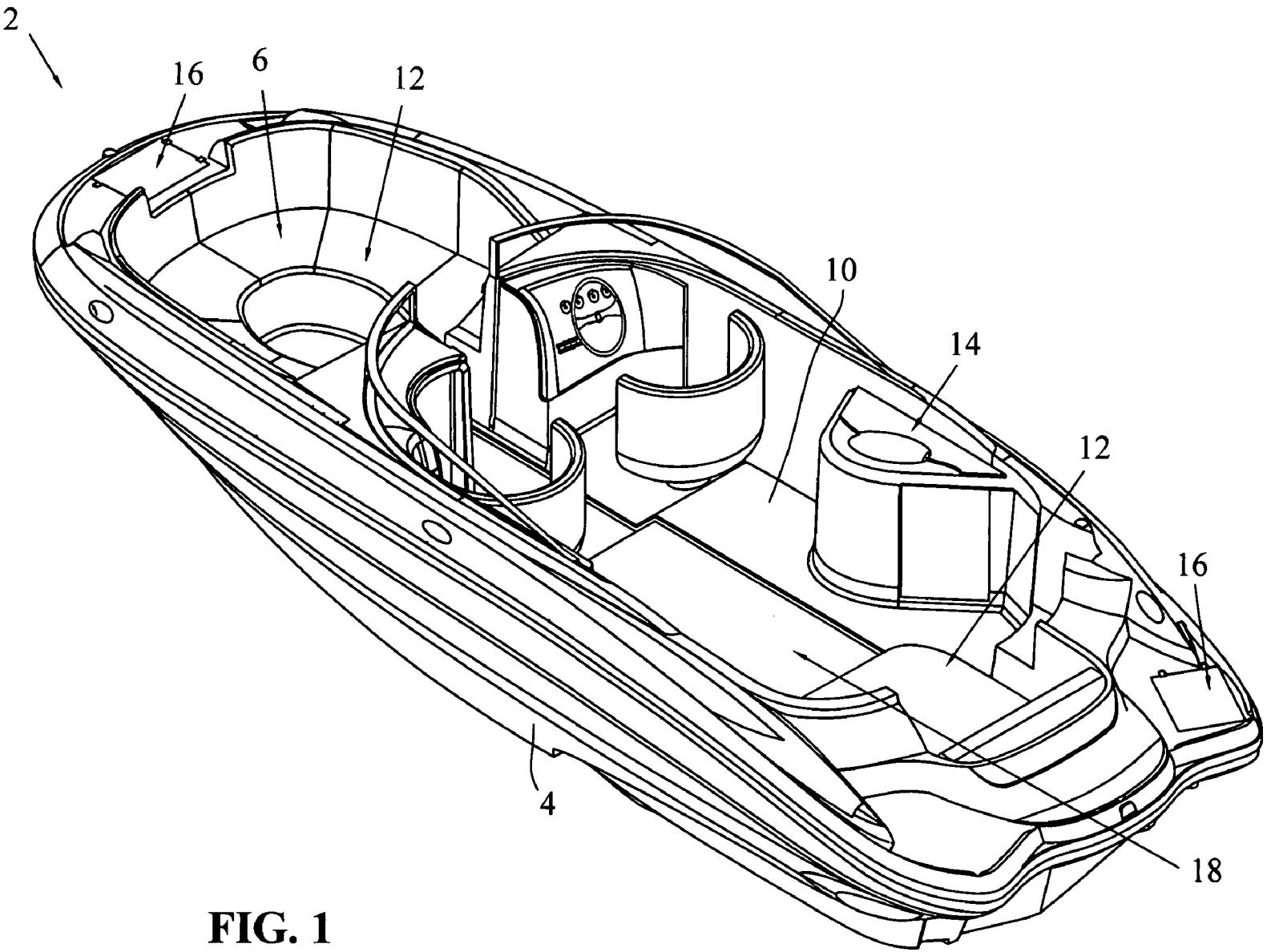
FIG. 1 is a perspective view of a watercraft including the ski closet of the present invention.

Referring in detail to the drawings and with particular reference first to FIG. 1, numeral 2 generally indicates a watercraft. Watercraft 2 of the present invention is commonly referred to in the art as a deck boat. It should be understood that a deck boat is being shown for illustrative purposes only, and accordingly, the present invention is not limited for use in deck boats alone but rather may be adapted for use in other type of water craft, if desired.

Referring still to FIG. 1, in the present embodiment, deck boat 2 includes a hull portion 4 and a deck portion 6. Hull portion 4 is manufactured via a conventional process and comprises any material known in the art, such as fiberglass. In the present embodiment, deck portion 6 represents a unitary molded component positioned within hull portion 4 and attached thereto in a conventional manner. It should be noted however, that deck portion 6 may be manufactured in a plurality of sections and then attached to hull portion 4, if desired. As would be understood by one skilled in the art, the area intermediate the hull portion 4 and deck portion 6 defines a bilge (not shown).

Deck portion 6 may have any desired configuration. In the embodiment depicted in FIG. 1, deck portion 6 includes a deck 10, a plurality of seating areas generally indicated by numeral 12, a galley module 14 and a plurality of storage compartments 16. The seating areas 12 and galley module 14 may be affixed to deck 10 in any known manner or integrally formed therein. The storage compartments 16 are configured to store smaller components, such as ladders, anchors and similar items. The present embodiment of deck 10 includes an open area, generally indicated by numeral 18 extending proximate the center of deck 10. Open area 18 includes a ski storage closet 20 representing an embodiment of the present invention. The ski storage closet 20 is positioned in the walk-through area between the front windshield, as best shown in FIGS. 1 and 2.

Figure 2:
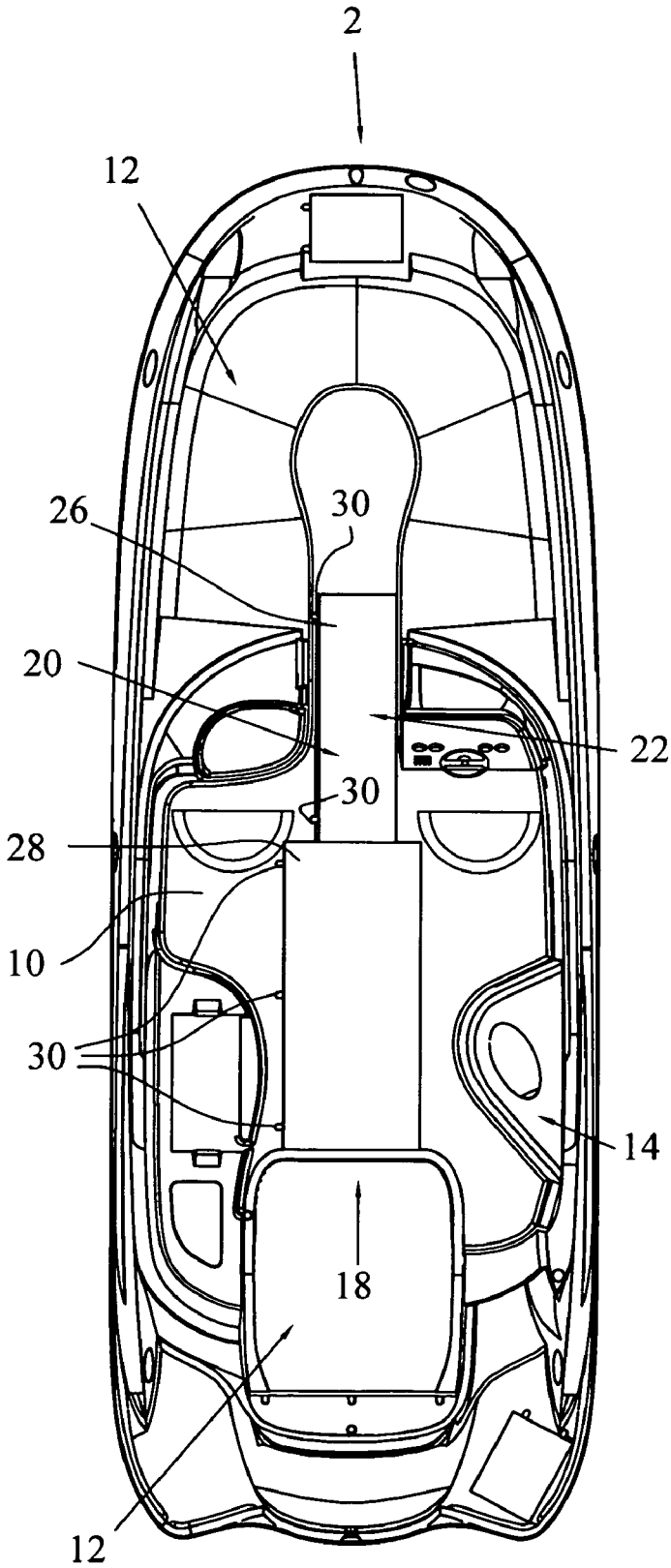
FIG. 2 is a top plan view of the watercraft shown in FIG. 1 with the cover of the ski closet closed.
Figure 3:
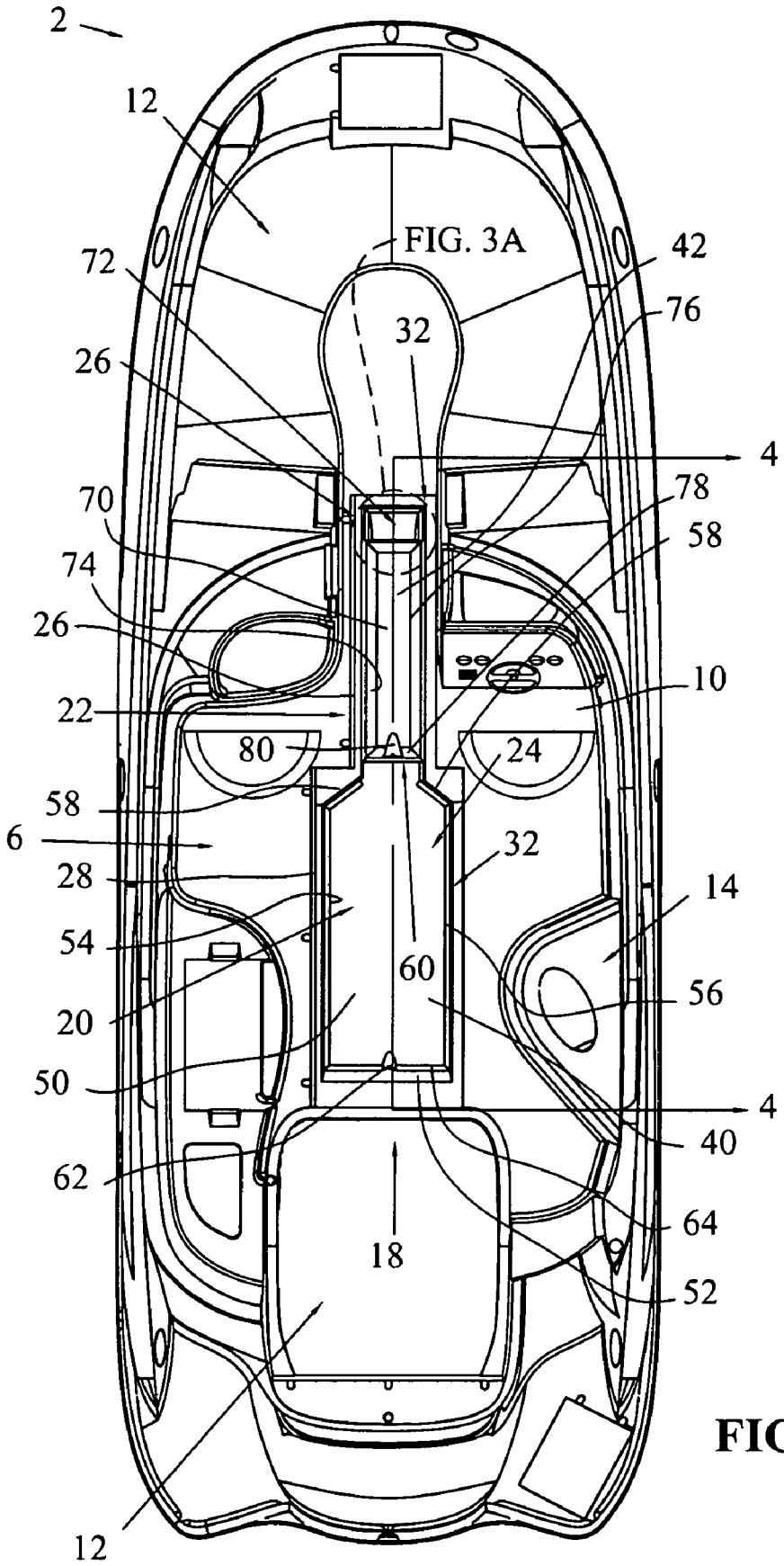
FIG. 3 is a top plan view of the watercraft shown in FIG. 2 with the cover of the ski closet open.

FIGS. 2 and 3 depict top plan views of watercraft 2. In the present embodiment, ski storage closet 20 includes a cover 22 and an interior portion 24. Cover 22 includes a first portion 26 and a second portion 28 and is manufactured from a sturdy, water resistant material such as fiberglass, for example.

As can be seen in FIG. 2, a plurality of hinges 30 connects cover 22 to deck 10. Hinges 30 allow cover 22 to move between a closed position, as depicted in FIG. 2, and an open position, as depicted in FIG. 3. When in the closed position (see FIG. 2) cover 22 conceals interior portion 24 of closet 20. When cover 22 is arranged in the open position (see FIG. 3) interior portion 24 is accessible.

In the present embodiment, cover 22 includes a conventional latching mechanism (not shown). The latching mechanism provides a mechanism for retaining cover 22 in the closed position depicted in FIG. 2, until a user releases the latch. Once the latch has been released, the user may then open cover 22 into the open position of FIG. 3. It should be noted that cover 22 may include a plurality of latching mechanisms, thereby allowing first portion 26 and second portion 28 to be independently latched in the closed position.

Referring now to FIG. 3, in the present embodiment, deck 10 further includes a recessed portion 32 formed therein. Recessed portion 32 encompasses the circumference of interior portion 24 at a depth approximately equal to the thickness of cover 22. Moreover, cover 22 is sized and configured to fit within the opening defined by recessed portion 32. Thus, when cover 22 is arranged in the closed position, as shown in FIG. 2, the top surface of cover 22 is flush with deck 10.

With reference to FIG. 3, once cover 22 is moved into the open configuration, it can be seen that an occupant (not shown) of watercraft 2 has access to the interior portion 24 of closet 20. In the present embodiment, interior portion 24 includes a first compartment 40 and a second compartment 42. First compartment 40 is positioned proximate the stern of watercraft 2 and second compartment 42 is positioned proximate the bow.

Figure 4A:
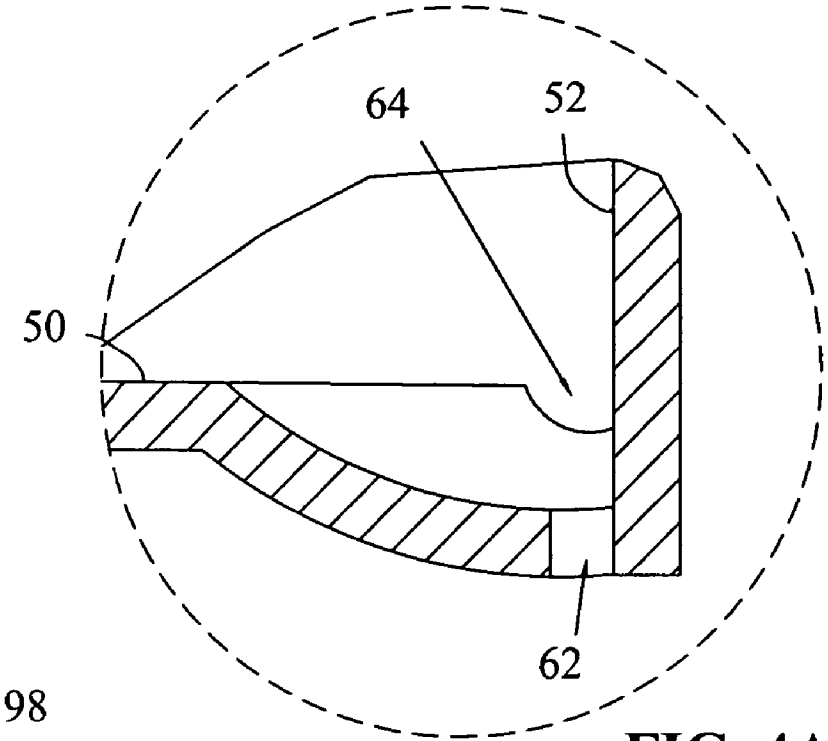
FIG. 4A is a magnified view of a portion of the ski closet shown in FIG. 4.
Figure 4:
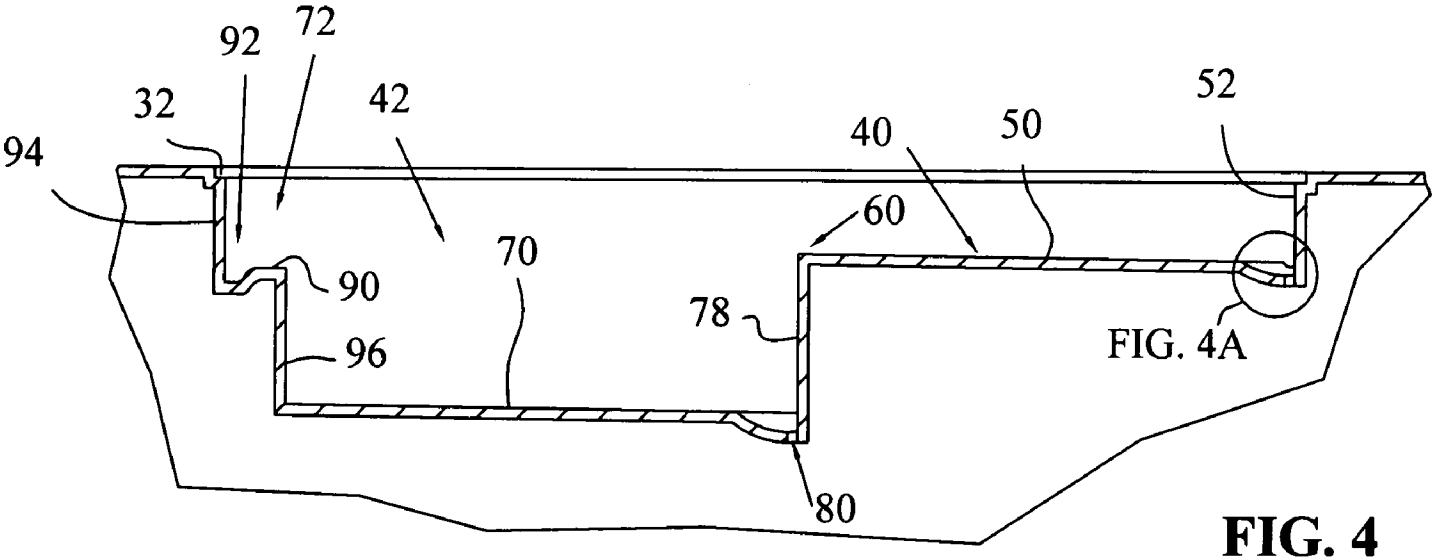
FIG. 4 is a section view of the ski closet shown in FIG. 3.

Referring now to FIGS. 3, 4 and 4A, first compartment 40 includes a floor 50, a rear wall 52, side walls 54, 56, tapered walls 58 and front brink 60. Floor 50 and walls 52, 54, 56, 58 may be manufactured from the same material comprising deck 10 and formed integrally with deck portion 6.

In the present embodiment, floor 50 includes a drain 62 formed integrally therein proximate rear wall 52. Drain 62 connects the interior of first compartment 40 with the bilge (not shown) thereby allowing water or similar waste to drain from the first compartment 40.

Floor 50 further includes a channel 64 integrally formed therein. In the present embodiment, channel 64 is positioned proximate each of rear wall 52, side walls 54, 56 and tapered walls 58. The various sections of channel 64 are interconnected in order to provide a conduit for water, or other liquids, to travel from front brink 60 to drain 62 without sullying the central, planar portion of floor 50. To accomplish this, both floor 50 and channel 64 are sloped in the direction of drain 62.

In the present embodiment, the walls 52, 54, 56 and 58 extend vertical, intermediate floor 50 and recessed portion 32. Conversely, front brink 60 represents an opening between front compartment 40 and second compartment 42.

Figure 3A:
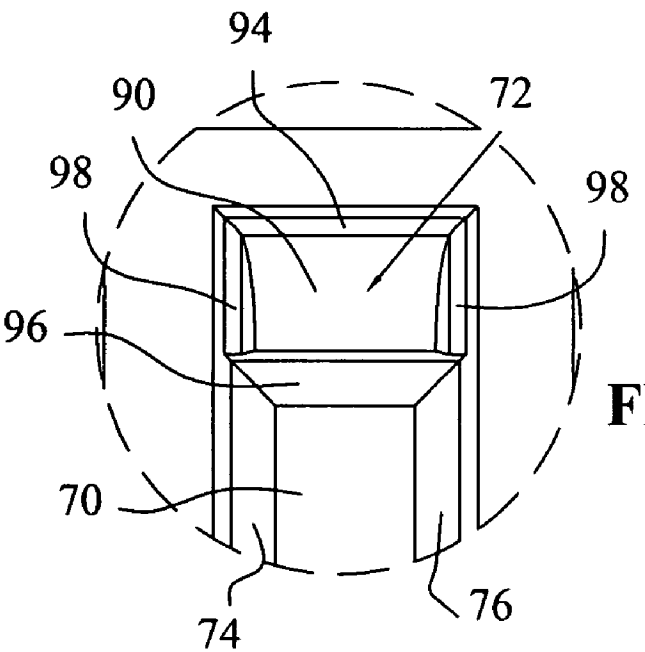
FIG. 3A is a magnified view of a portion of the ski closet shown in FIG. 3.

Referring now to FIGS. 3, 3A and 4A, second compartment 42 will now be described. In the present embodiment, second compartment 42 includes a floor 70, a front area generally indicated by numeral 72, side walls 74, 76 and rear wall 78. Floor 70 is similar to floor 50, described above; in that floor 70 may be comprised of the same material comprising deck 10 and integral to deck portion 6.

Floor 70 includes a drain 80 positioned proximate rear wall 78. In a manner similar to drain 62, described above, drain 80 connects second compartment 42 to the bilge (not shown). Also, in a manner similar to floor 50, floor 70 is orientated rearward toward rear wall 78 in order to direct liquid toward drain 80. It should be noted that in the present embodiment, floor 70 is recessed into deck portion 6 deeper than floor 50.

In the present embodiment, front area 72 and side walls 74, 76 each extend vertical at a position intermediate floor 70 and recessed portion 32 of deck 10. Similarly, rear wall 78 extends vertically at a position intermediate floor 70 and front brink 60 of first compartment 40. In the present embodiment, front area 72 and side walls 74, 76 rear wall 78 are formed integrally in deck portion 6.

Referring now to FIGS. 3 and 4, it can be seen that front area 72 includes a raised portion 90, a receiving area 92, an upper front wall 94 a lower front wall 96 and channels 98. Raised portion 90 and receiving area 92 are positioned intermediate upper front wall 94 and lower front wall 96. In the present embodiment, the upper surface of raised portion 90 has an arcuate, tapered shape. The area intermediate raised portion 90 and upper front wall 94 defines the receiving area 92. In the present embodiment, channels 98 are positioned intermediate the side walls 74, 76 and raised portion 90 thereby providing a conduit between the receiving area 92 and the portion of second compartment rearward of lower front wall 96.

In the present embodiment, upper front wall 94 extends vertical, intermediate the recessed portion 32 of deck 10 and receiving area 92. Similarly, lower front wall 96 extends vertical, intermediate raised portion 90 and floor 70. In the present embodiment, raised portion 90 and walls 94, 96 may be manufactured of the same material comprising floor 70 and deck 10. Additionally, front walls 94, 96 are integral to deck portion 6.

It should be noted that closet 20 may be used to store various items typically utilized in standard watercraft, such as fishing poles and coolers. The present embodiment of closet 20 is configured to store skis, wakeboards and the like.

Figure 5:
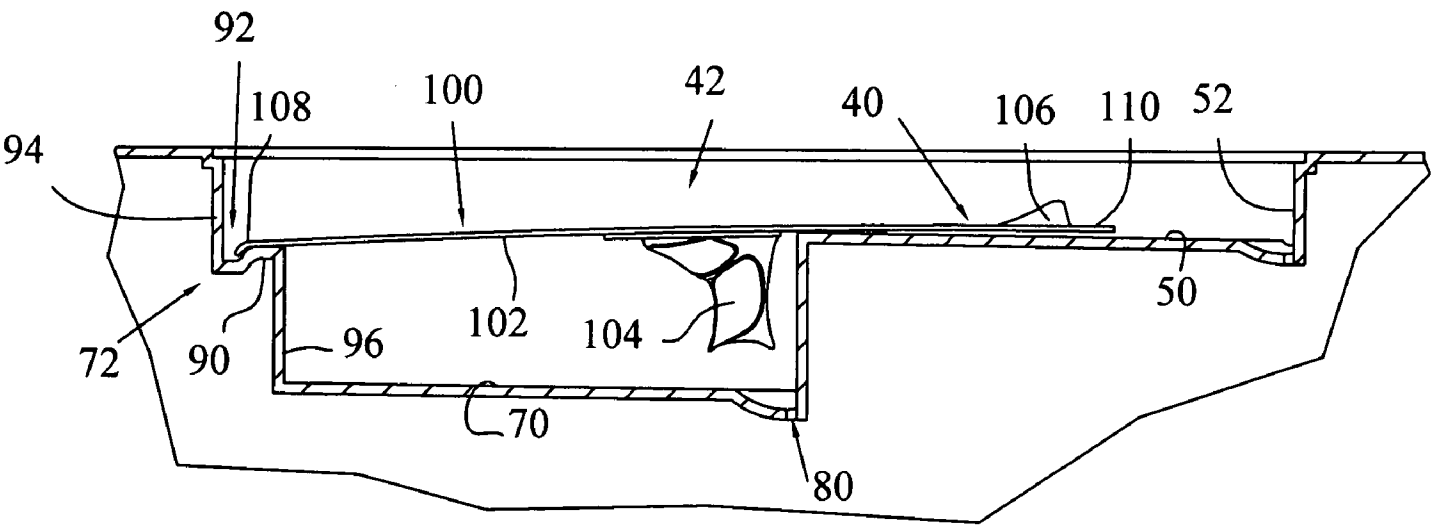
FIG. 5 is a section view of the ski closet shown in FIG. 4 with a ski depicted in order to demonstrate storage of a ski within the closet.

With reference now to FIG. 5, a section view of closet 20 retaining a water-ski, generally indicated by numeral 100, is depicted. Water-ski 100 includes a ski portion 102, a boot 104 and a fin 106. Ski portion 102 may be manufactured from a planar piece of wood or reinforced composite, as is known in the art. Ski portion 102 includes a tip 108 and a tail 110. In the embodiment depicted, tip 108 is slightly curved and tail 110 is substantially planar.

Boot 104 is attached to the top surface of ski portion 102 in a known manner. Boot 104 is positioned approximately equidistant from tip 108 and tail 110. As will be known to someone with skill in the art, boot 104 receives the foot of a water-skier (not shown) thereby providing a means of attaching water-ski 100 to the skier.

Fin 106 is attached to the bottom surface of ski portion 102 proximate tail 110. Fin 106 provides a means of steering the water-ski 100 while skiing to the water-skier.

Referring still to FIG. 5, a section view of storage closet 20 storing water-ski 100 is depicted. As can be seen, water-ski 100 is orientated upside down, with boot 104 directed downward and fin 104 directed upwards when placed within closet 20. When water-ski 100 is properly arranged, the curved portion of tip 108 rests upon raised portion 90, as depicted.

In addition, a portion of ski portion 102 also contacts floor 50 at front brink 60. Accordingly, the tail 110 of ski portion 102 extends into first compartment 40. As shown in FIG. 5, the height of the walls 52, 54, 56, 58 in front compartment 40 is greater than the size of fin 106, thereby ensuring fin 106 does not extend out of closet 20.

With water-ski 100 properly positioned within closet 20, as described above, some of the novel features of the invention with be described. For example, the arcuate configuration of raised portion 90 provides a mechanism for retaining water-ski 100 in a fixed position within closet 20. Specifically, the overlap of the curvature of tip 108 on raised portion 90 prevents water-ski 100 from sliding rearward when the water craft 20 accelerates.

It should also be noted that in the present embodiment, the height of rear wall 78 with respect to floor 70, is greater than the height of raised portion 90. Accordingly, once water-ski 100 has been placed within closet 20, tip 108 is positioned lower than tail 110. Once water-ski 100 has been arranged in this manner, the likelihood that water-ski 100 will shift toward the rear of watercraft 2 as watercraft 2 accelerates is reduced.

In addition, as will be understood by one with skill in the art, after being used for recreational purposes, water adheres to the surfaces of ski portion 102, boot 104 and fin 106. Thus, a water-ski 100 placed into storage closet 20 will drip water into the interior space of the closet 20 after use, and boat 104 will also drain.

It should be apparent from FIG. 5, that water dripping from the portion of water-ski 100 located in first compartment 40 will contact floor 50. As explained above, floor 50 is sloped rearward toward drain 62 (FIG. 4A). Accordingly, any water dripping from water-ski 100 onto floor 50, will be pulled by gravity down the slope of floor 50 toward drain 62. Additionally, as the watercraft 2 rocks due to waves in the water upon which the craft rests, water resting on floor 50 will flow transversely into channel 64. Once water flows into channel 64, the water is prevented from further traveling across floor 50. As should be apparent, the overall configuration of first compartment 40 directs water toward drain 62. Once the water reaches drain 62, the water travels through the drain 62 into the bilge of the watercraft.

In a manner similar to that described immediately above, water that drips from boot 104 drips onto floor 70. Since floor 70 is sloped backwards towards rear wall 78, water dripping from water-ski 100 will be directed towards drain 80. The funnel portion of drain 80 directs the water through the aperture in drain 80 and into the bilge of the watercraft.

Referring to FIGS. 3, 3A and 5, it becomes apparent that water (not shown) adhering to ski 100 may travel to the tip 108 and be deposited within receiving area 92 and accumulate. Channels 98 (FIG. 3A) positioned proximate the sides of raised portion 90 provide a mechanism to allow the water within receiving area 92 to drain therefrom. The water that exits receiving area 92 through channels 98 flows onto floor 70 and out drain 80 into the bilge of the watercraft 2.

It is worth noting that after use, a majority of the water dripping from water-ski 100 will drip from boot 104. Moreover, a majority of water dripping from ski portion 102 will drip closer to tip 108 than tail 110 since water-ski 100 is titled forward. The relatively little water being located within first compartment 40 with respect to second compartment 42, makes first compartment 40 a more desirable storage area for additional components, while the greater water volume in second compartment 42 makes second compartment 42 less desirable for storing additional items. Thus, as depicted in FIGS. 2 and 3, in the present embodiment of closet 20, first compartment 40 is wider than second compartment 42 in order to increase the storage capacity thereof.

While this invention has been described as having an exemplary design, the present invention may be further modified within the spirit and scope of this disclosure. The application is, therefore, intended to cover any variations, uses, or adaptations of the invention using its general principles. Further, this application is intended to cover such departures from the present disclosure as come within known or customary practice in the art to which this invention pertains.

I claim:

1. A closet for storing at least one water-ski in a watercraft including a deck, said closet including:

a compartment profiled for receiving said at least one water-ski including a tail, a tip and a boot and said boot is located intermediate said tip and said tail; and a cover moveable between an open position and a closed position, said open position allowing access to said compartment and said closed position concealing said compartment;

a first portion and a second portion, wherein said tail and said boot are located in said first portion and said tail is located in said second portion, said first portion includes a first floor and said second portion includes a second floor, said first floor being deeper with respect to said deck than said second floor;

a first drain located in said first floor, and an opening connecting said first portion to said second portion;

wherein said compartment is located below said deck and said cover is flush with said deck when said cover is in said closed position and said compartment is configured to receive said water-ski in an upside down orientation without compressing said boot.

2. The closet for storing at least one water-ski as set forth in claim 1 further including a plurality of hinges connecting said cover to said deck in order to allow said cover to rotate between said open position and said closed position.

3. The closet for storing at least one water-ski as set forth in claim 1 wherein said first floor is sloped toward said first drain.

4. The closet for storing at least one water-ski as set forth in claim 1 wherein said water-ski extends though said opening and said boot is positioned in the deepest of said first portion and said second portion.

5. The closet for storing at least one water-ski as set forth in claim 1 further including means for preventing forward and rearward movement of said water-ski.

6. The closet for storing at least one water-ski as set forth in claim 5 wherein said means for preventing movement includes a raised surface engaging said tip of said water-ski.

7. The closet for storing at least one water-ski as set forth in claim 6 wherein said raised surface is arcuate.

8. The closet for storing at least one water-ski as set forth in claim 5 wherein said means includes:

a receiving area for receiving a portion of said tip of said water-ski; and at least one channel allowing a liquid to flow from said receiving area to said first drain.

9. The closet for storing at least one water-ski as set forth in claim 5 wherein said means is positioned proximate a longitudinal end of said closet.

10. The closet for storing at least one water-ski as set forth in claim 5 wherein said means is positioned at a vertical height intermediate said first floor and said second floor.

11. The closet for storing at least one water-ski as set forth in claim 1 wherein said cover includes a first portion and a second portion, said first portion of said cover configured to conceal said first portion of said compartment and said second portion of said cover configured to conceal said second portion of said compartment.

12. The closet for storing at least one water-ski as set forth in claim 11 wherein said second portion of said compartment is wider than said first portion.

13. The closet for storing at least one water-ski as set forth in claim 1 further including a second drain located in said second floor.

14. The closet for storing at least one water-ski as set forth in claim 13 further including a channel disposed along a portion of an edge of said second floor wherein said channel is connected to said second drain.

15. The closet for storing at least one water-ski as set forth in claim 1 wherein a portion of said closet is integrally formed in said deck of said watercraft.

* * * * *